US008042448B1

(12) United States Patent
Sylvester et al.

(10) Patent No.: US 8,042,448 B1
(45) Date of Patent: Oct. 25, 2011

(54) FIREARM MUZZLE ATTACHMENT

(75) Inventors: Dean Sylvester, Boise, ID (US); Todd Tuttle, Boise, ID (US)

(73) Assignee: Primary Weapons, Boise, ID (US)

( * ) Notice: Subject to any disclaimer, the term of this patent is extended or adjusted under 35 U.S.C. 154(b) by 343 days.

(21) Appl. No.: 12/360,010

(22) Filed: Jan. 26, 2009

Related U.S. Application Data

(60) Provisional application No. 61/023,163, filed on Jan. 24, 2008.

(51) Int. Cl.
*F41A 21/34* (2006.01)
*F41A 21/36* (2006.01)

(52) U.S. Cl. ..... 89/14.3; 89/14.2; 42/1.06; 42/79

(58) Field of Classification Search ..... 89/14.2, 89/14.3, 14.4; 42/1.06, 79
See application file for complete search history.

(56) References Cited

U.S. PATENT DOCUMENTS

| | | | | | |
|---|---|---|---|---|---|
| 1,369,085 | A | * | 2/1921 | Craig | 89/14.3 |
| 1,415,919 | A | | 5/1922 | Butler et al. | |
| 2,322,370 | A | | 6/1943 | Lance | |
| 2,499,428 | A | | 3/1950 | Tiffany | |
| 2,953,972 | A | * | 9/1960 | Sorensen | 89/14.3 |
| 3,455,203 | A | | 7/1969 | Pillersdorf | |
| 3,483,794 | A | * | 12/1969 | Packard | 89/14.2 |
| 3,710,683 | A | * | 1/1973 | Kaltmann | 89/14.2 |
| 3,858,481 | A | * | 1/1975 | Elliott | 89/14.3 |
| 4,057,003 | A | * | 11/1977 | Atchisson | 89/138 |
| 4,374,484 | A | * | 2/1983 | Bekker et al. | 89/14.3 |
| 4,643,073 | A | * | 2/1987 | Johnson | 89/14.3 |
| 4,664,014 | A | | 5/1987 | Hawley et al. | |
| 4,691,614 | A | | 9/1987 | Leffel et al. | |
| D296,350 | S | | 6/1988 | Cellini | |
| 4,893,544 | A | | 1/1990 | Hawley et al. | |
| 4,913,031 | A | * | 4/1990 | Bossard et al. | 89/14.3 |
| 4,930,397 | A | | 6/1990 | Seidler | |
| 4,967,642 | A | * | 11/1990 | Mihaita | 89/126 |
| 5,005,463 | A | * | 4/1991 | A'Costa | 89/14.2 |
| 5,385,079 | A | | 1/1995 | Cave | |
| 5,476,028 | A | | 12/1995 | Seberger | |
| 5,549,030 | A | | 8/1996 | Lespron | |
| 5,587,549 | A | | 12/1996 | Clouse | |
| 5,596,161 | A | * | 1/1997 | Sommers | 89/14.2 |
| 5,612,504 | A | | 3/1997 | Stitt et al. | |
| 5,811,714 | A | | 9/1998 | Hull et al. | |
| D417,252 | S | | 11/1999 | Kay | |
| 6,722,254 | B1 | | 4/2004 | Davies | |
| 6,752,062 | B2 | | 6/2004 | Vais | |
| 6,899,008 | B2 | | 5/2005 | Breuer | |
| 7,032,339 | B1 | | 4/2006 | Bounds | |
| 7,059,235 | B2 | | 6/2006 | Hanslick et al. | |
| 7,143,680 | B2 | * | 12/2006 | Bender | 89/14.3 |
| 7,789,009 | B1 | * | 9/2010 | Brittingham | 89/14.4 |
| 7,861,636 | B1 | * | 1/2011 | Hoffman | 89/14.2 |
| 2003/0106416 | A1 | * | 6/2003 | Vais | 89/14.3 |
| 2003/0106417 | A1 | * | 6/2003 | Vais | 89/14.3 |
| 2005/0188829 | A1 | * | 9/2005 | Hanslick et al. | 89/14.3 |
| 2009/0178549 | A1 | * | 7/2009 | Meyers | 89/14.2 |
| 2010/0269387 | A1 | * | 10/2010 | Drajan | 42/1.06 |

* cited by examiner

*Primary Examiner* — Bret Hayes
*Assistant Examiner* — Joshua Freeman
(74) *Attorney, Agent, or Firm* — Dwayne E. Rogge; Hughes Law Firm, PLLC

(57) ABSTRACT

A muzzle device configured to be attached to the muzzle region of a barrel. The muzzle device has a compensator region positioned longitudinally rearward from a flash suppression region. The muzzle device further is provided with adjacent compensator ports in communication by a longitudinally extending access vent.

24 Claims, 17 Drawing Sheets

FIREARM MUZZLE ATTACHMENT

RELATED APPLICATIONS

This application claims priority of U.S. Provisional Ser. No. 61/023,163 filed Jan. 24, 2008.

BACKGROUND

Muzzle attachments are utilized on firearms for various enhancements thereof. In general, for example with a rifle, a muzzle attachment such as a compensator or a flash suppressor is commonly attached to muzzles by the operator or owner of the firearm. Expanding combusting gas from a cartridge used to propel a bullet can generally be utilized for various purposes, such as providing an upward thrust of the gas, thereby providing a counterbalance downward force upon the muzzle to prevent muzzle lift. In general, firearms tend to raise in a twelve o'clock direction after firing due to the various force dynamics of the accelerating bullet and the position of the barrel, as well as the ergonomic factors of the position of the rifle upon the shooter. At any rate, it is generally desirable to keep the muzzle "flat" during firing to provide a more stable platform for follow-up shots. In particular, with a semi-automatic, it is desirable to have some form of compensator to prevent muzzle lift, because with a semi-automatic, a second shot can follow up much quicker than a bolt action or other form of manual action rifle. Further, with a full automatic weapon, where the rate of fire can be up to (for example) 600 rounds per minute, the rapid exertion of bullets creates a counter-acting force upon the rifle. Therefore a compensator to prevent muzzle lift is very desirable for full automatic fire.

Another possible use of a compensator is to suppress a flash. In general, a straight-cut barrel without any form of compensation but merely having a circular opening can create a muzzle flash, which can be undesirable in certain law enforcement and military applications where the shooter will not want to give away their location. Further, a muzzle flash can be distracting for a shooter. Generally, certain types of flash suppressors have been utilized, such as offsetting Gore-Tex channels. However, such a symmetrical design emitting gas rather symmetrically in the vertically upward and downward direction will not have an effect on preventing muzzle rise. However, the exiting vortexing gas generally must be at the longitudinally forward-most region. Any form of lift compensation then, in one form, would be positioned longitudinally rearward of such a flash suppressing vortexing region. Of course, providing such a lift compensation region having emitting gas would, on the face of it, appear to emit the pre-combusted flame producing gas, which would thwart the effect of the vortexing flash suppressing region, which is further downstream on the muzzle. However, after various forms of experimentation, the applicants have found a suitable muzzle attachment which provides for flash suppression and the lowering of muzzle flip.

SUMMARY OF DISCLOSURE

Disclosed herein is a muzzle compensator having a first and second lateral region and forward and rearward longitudinal regions. The compensator further having an upper and lower vertical region. The muzzle compensator is configured to attach to a muzzle of a firearm such as by way of a threaded attachment in one form. The muzzle compensator has a center bore having a center bore axis. There is further an attachment region having a threadably engaged portion with a torque receiving surface. The compensator comprises a vortexing region having a plurality of vortex channels with a center axis that are offset from the center bore axis and substantially perpendicular thereto. the vortexing region provides flash suppression qualities which is desirable for suppressing a flash.

The muzzle compensator further has a compensator region having a first pair of first and second longitudinally rearward slanted surfaces defining in part first and second lateral compensation ports. There are further first and second counter lift surfaces positioned in the first and second lateral regions respectively. The first and second counter lift surfaces being in communication with first and second access vents which provide communication to the center bore.

In one form the muzzle compensator has a second pair of longitudinally rearward slanted surfaces positioned on the first and second lateral regions of the muzzle compensator defining in party third and fourth lateral compensation ports. In this orientation the first access vent provides communication between the first and third lateral compensation ports. Further the second access vent provides communication between the second and fourth lateral compensation ports. It should further be noted that in one form the width of the second access vent is greater than the width of the first access vent. For example, in one embodiment the second access vent is at least 0.025" larger in width than the first access vent where the firearm has a right-handed twist barrel.

In one form the disclosure herein is described a muzzle device with first and second laterally opposing port openings defined by first and second interior edge services. There are further third and fourth longitudinally opposing port openings further defined by third and fourth interior edge surfaces respectfully.

A first access vent is provided extending in a longitudinal direction and defined by first and second edge surfaces. This first access vent provides communication between the first and third port openings. There is further a second access vent defined by third and fourth interior edge surfaces and this second access vent extends in the longitudinal direction and provides communication between the second and fourth compensator ports.

The muzzle device has a first counter lift surface positioned adjacent to the first access vent a horizontal component thereof configured to have pressurized gas impinge thereupon when exiting the first access vent. Further there is a second counter lift surface positioned adjacent to the second access vent, the second counter lift surface having a horizontal component configured to have the compressed gas impinge thereupon when exiting the second access vent.

In one form the muzzle device is configured where the first access vent has a greater open cross-sectional area than the second access vent. Further, the first, second, third and fourth compensator ports can each have longitudinally rearward slanted services operatively configured to direct the expanding gas in a longitudinally rearward direction. In this configuration the distance between the first and second interior edge surfaces defining the first access vent is greater than the distance between the third and fourth interior edge surfaces defining the second axis vent.

In one form, the muzzle device first counter lift surface can provide a greater rotational torque than the second counter lift surface when expanding gas exits through the first and second access vents. In another form a flash suppression region is positioned longitudinally forward of the first, second, third and fourth compensator vents. With a flash suppression region, a plurality of channels are defined in one form having channel center axes that are offset from a longitudinal center axis of the compensator member. A baffle can be interposed between the first and second compensator ports and the flash suppression region. In experimentation the baffle can be less than 0.090 inches in diameter than the size of a bullet designed to pass through the muzzle device and is approximately 0.060 inches in diameter greater than the size of a prescribed bullet diameter for use with the muzzle device

DESCRIPTION OF THE PREFERRED EMBODIMENTS

Figure 1A:
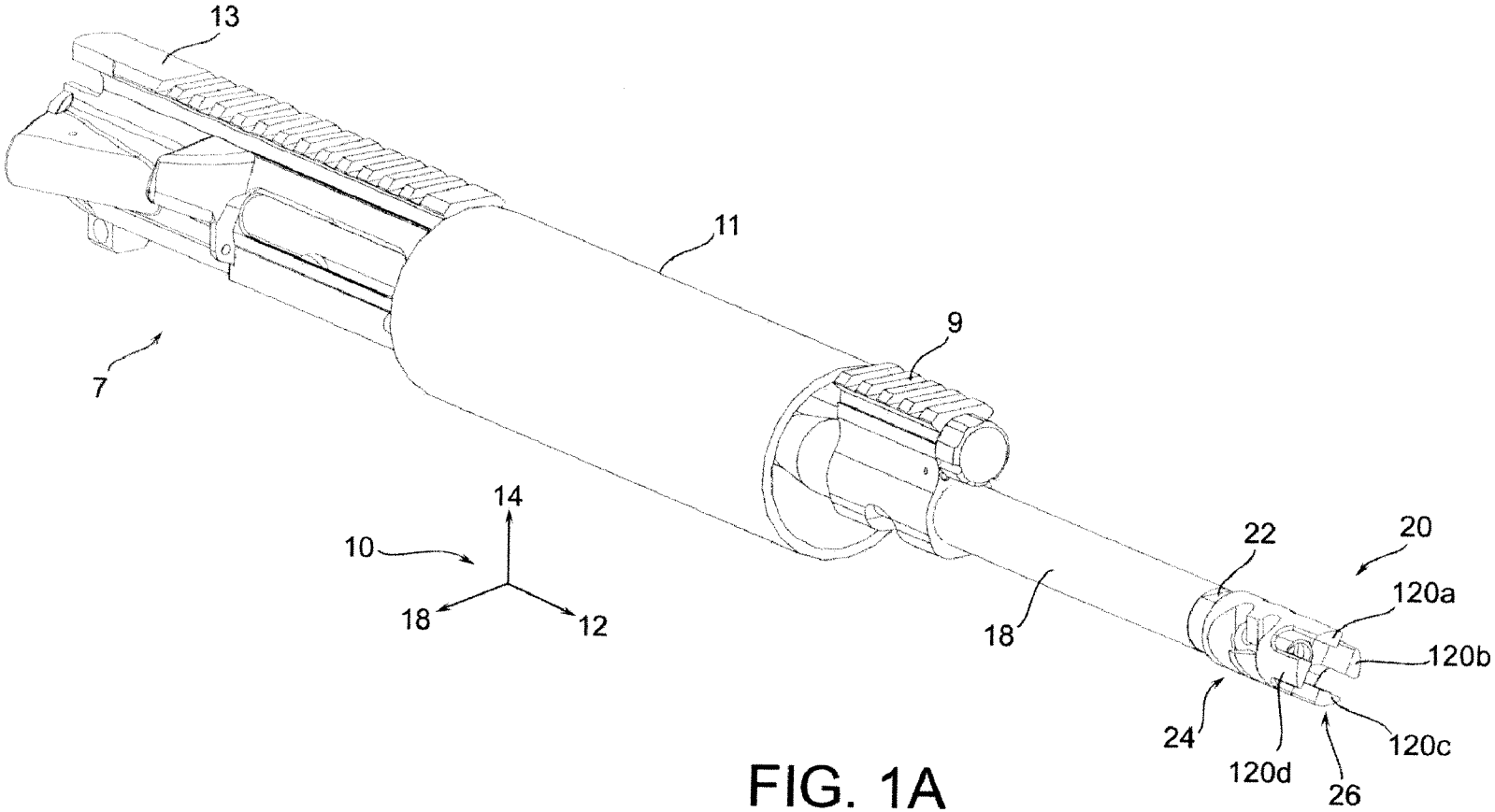
FIG. 1A shows an isometric view of the muzzle device attached to an upper assembly of a rifle.
Figure 4:
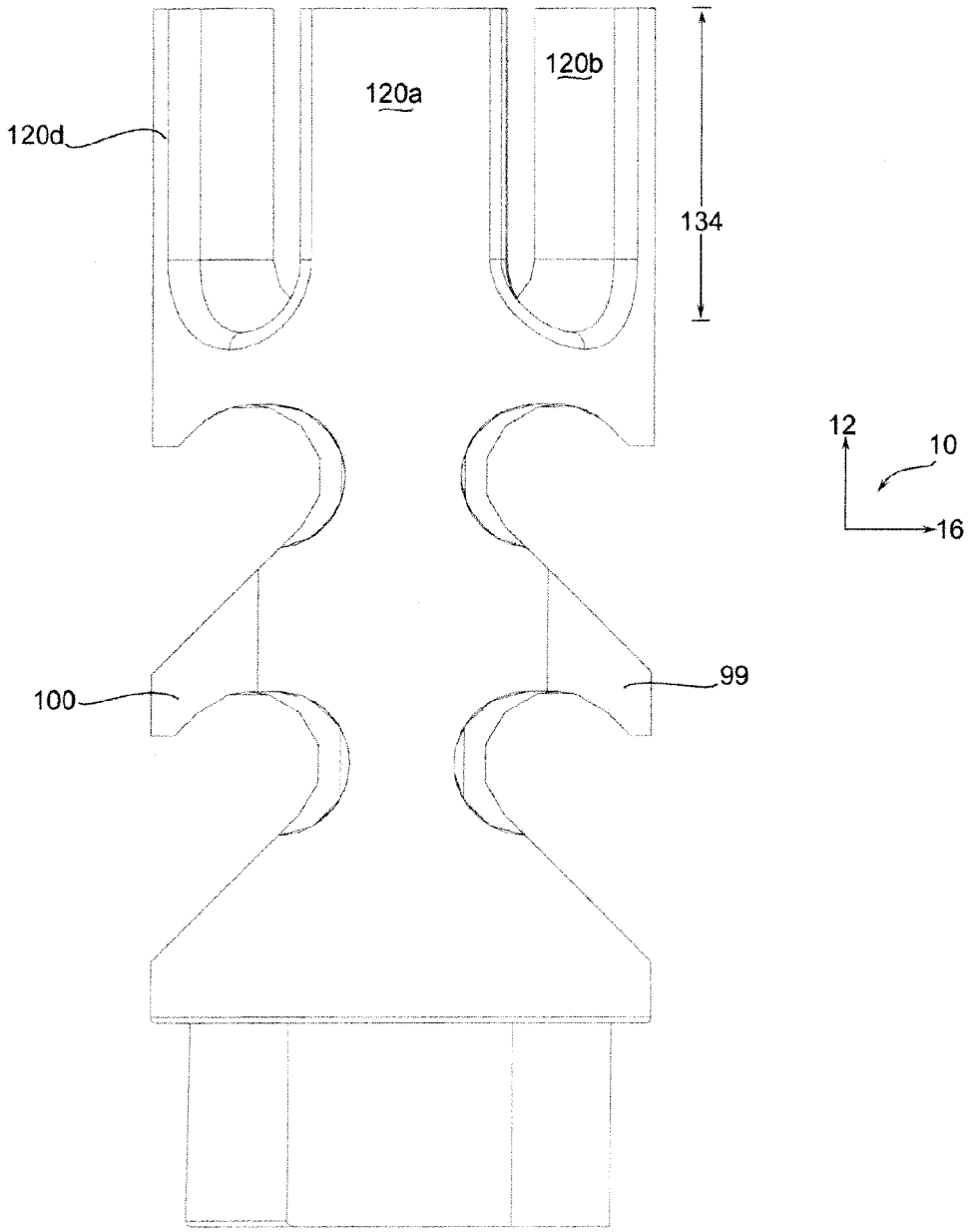
FIG. 4 shows a top view of the muzzle device.

Referring to FIG. 1A, there is shown an environmental view where the muzzle device 20 is shown attached to a barrel member 18. Before further discussion of the muzzle device 20, there is first defined an axes system 10 where, as shown in FIG. 1, the axis 12 indicates a longitudinal axis pointing in a longitudinally forward direction. The axis 14 indicates a vertical direction, and the axes system 10 as shown in FIG. 4 shows the lateral axis 16 pointing in a first lateral direction which in one form is to the right-hand portion of the muzzle device 20.

Referring now back to FIG. 1A, there is generally shown on the muzzle device an attachment region 22, a compensator region 24, and a vortex/flash suppression region 26. As described further herein, the desirable arrangement of the compensator region 24 and the vortex region 26 provides a desirable distribution of the exhausting muzzle gas, which is described further below.

FIG. 1A in one form shows a barrel 18 which is a part of an upper assembly 7 which can be an upper assembly for an AR-15. However, the muzzle device 20 could be attached to a variety of types of firearms, and not only rifles but further, for example, pistols. In general, the upper assembly 7, for example, is configured to be attached to a lower assembly to complete the firearm. The upper assembly comprises a gas block 9, a hand guard 11 and an upper receiver 13. Of course, in other forms, such as in a bolt action gun, there would not be a gas block which provides communication to the barrel 18 for operating a semi automatic (or full automatic) action of the carriage assembly within the upper receiver 13.

Figure 1B:
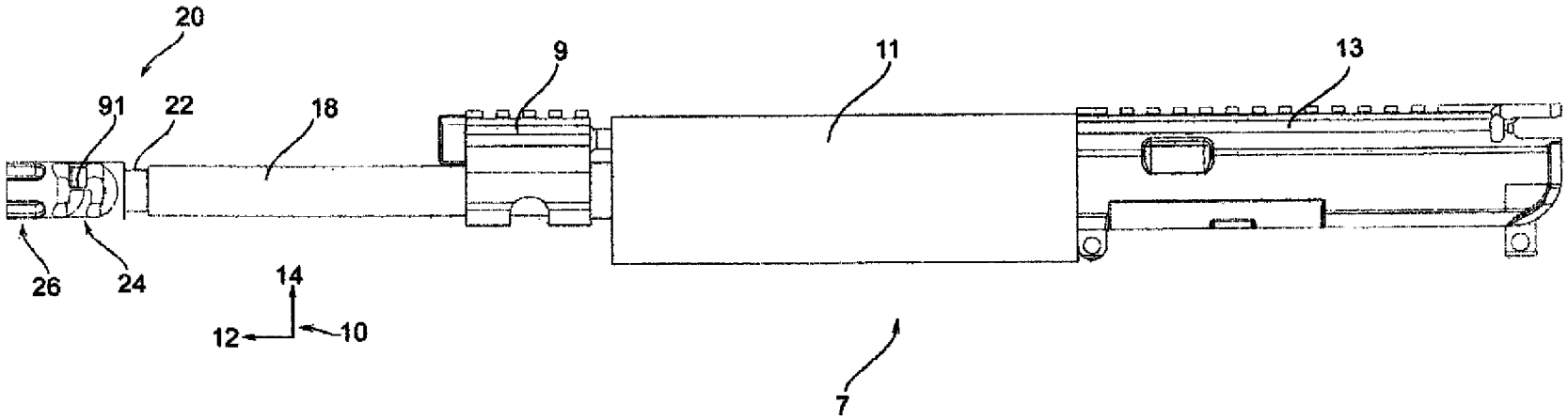
FIG. 1B shows a side view of the muzzle device with the upper assembly of the rifle.
Figure 1C:
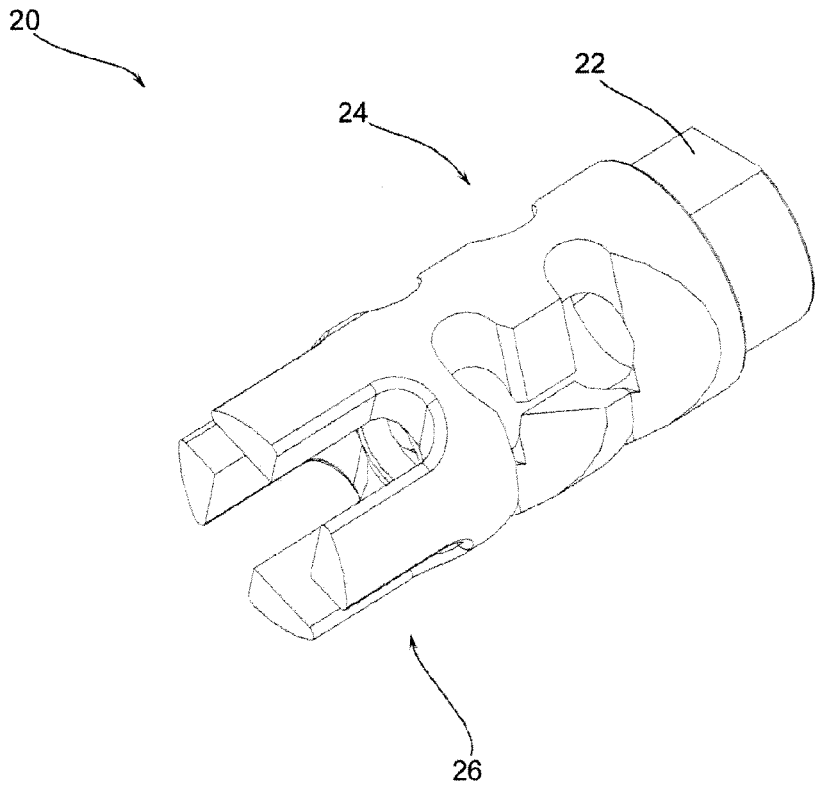
FIG. 1C shows an isometric view and a longitudinally forward region of the muzzle device.

FIG. 1B shows a side view of the muzzle device 20. In one form the attachment region 22 as described immediately below is threaded to the longitudinally forward portion of the barrel 18. As described herein after a detailed description of the muzzle device 20, the muzzle device 20 is particularly advantageous for suppressing flashes by way of the flash suppression region 26, and further particularly conducive for reducing muzzle flip and overall felt recoil, which is accomplished at least in part by the compensator region 24. As further described herein, in one form, access vents 90 and 91 (the vent 91 shown in FIG. 1B) provide in part communication to substantially horizontal surfaces (in one form) which reduce muzzle flip. Of course, the longitudinally rearward slanting surfaces 44 and 46 as well as 64 and 66 (FIG. 8) direct the expanding gas longitudinally rearwardly to reduce felt recoil upon the firearm for the shooter. This general introduction is provided because in one form, the compensator region 24 positioned longitudinally rearward to the flash suppression region 26 has proven to have a surprising effect of maintaining a flash suppression device by way of producing a vortex-like action out of the channel regions 128 (described further herein with reference to FIG. 3) and maintaining a compensator like effect with the various surfaces in the compensator region 24. In other words, in one form, the particular arrangement of the compensator region 24 and the flash suppression region 26 provides a flash suppression device even though the open first and second port openings (FIGS. 2 and 6) 54 and 56 as well as 84 and 86 of the compensator region are longitudinally rearward with respect to the flash suppression region. Further analysis and description of this phenomenon will be described after a detailed discussion of various example forms of the muzzle device 20.

Figure 5:
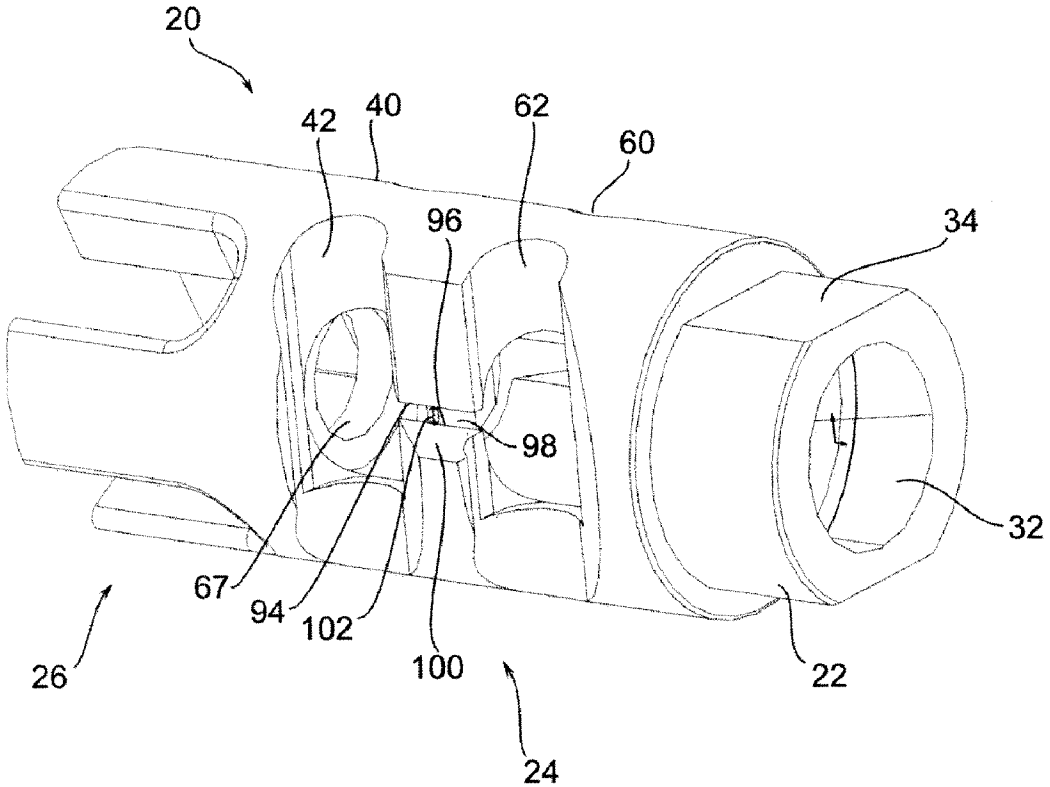
FIG. 5 shows an isometric view of the muzzle device taken from a longitudinally rearward and vertically upward vantage point.

Referring now to FIG. 5, there is shown a longitudinally rearward isometric view of the muzzle device 20 where the attachment region 22 is shown. In one form, the interior surface 32 is threaded to receive a male threading, for example, a barrel 18 as shown in FIG. 1. Of course in other forms, the attachment region could be otherwise attached to the muzzle region of the barrel by way of a permanent attachment such as welding or the like. In one form a torque receiving surface 34 is supplied. This surface is common in the industry for providing a wrench-like device for supplying a sufficient amount of torque to attach the muzzle device 20 to a barrel in one form.

Figure 2:
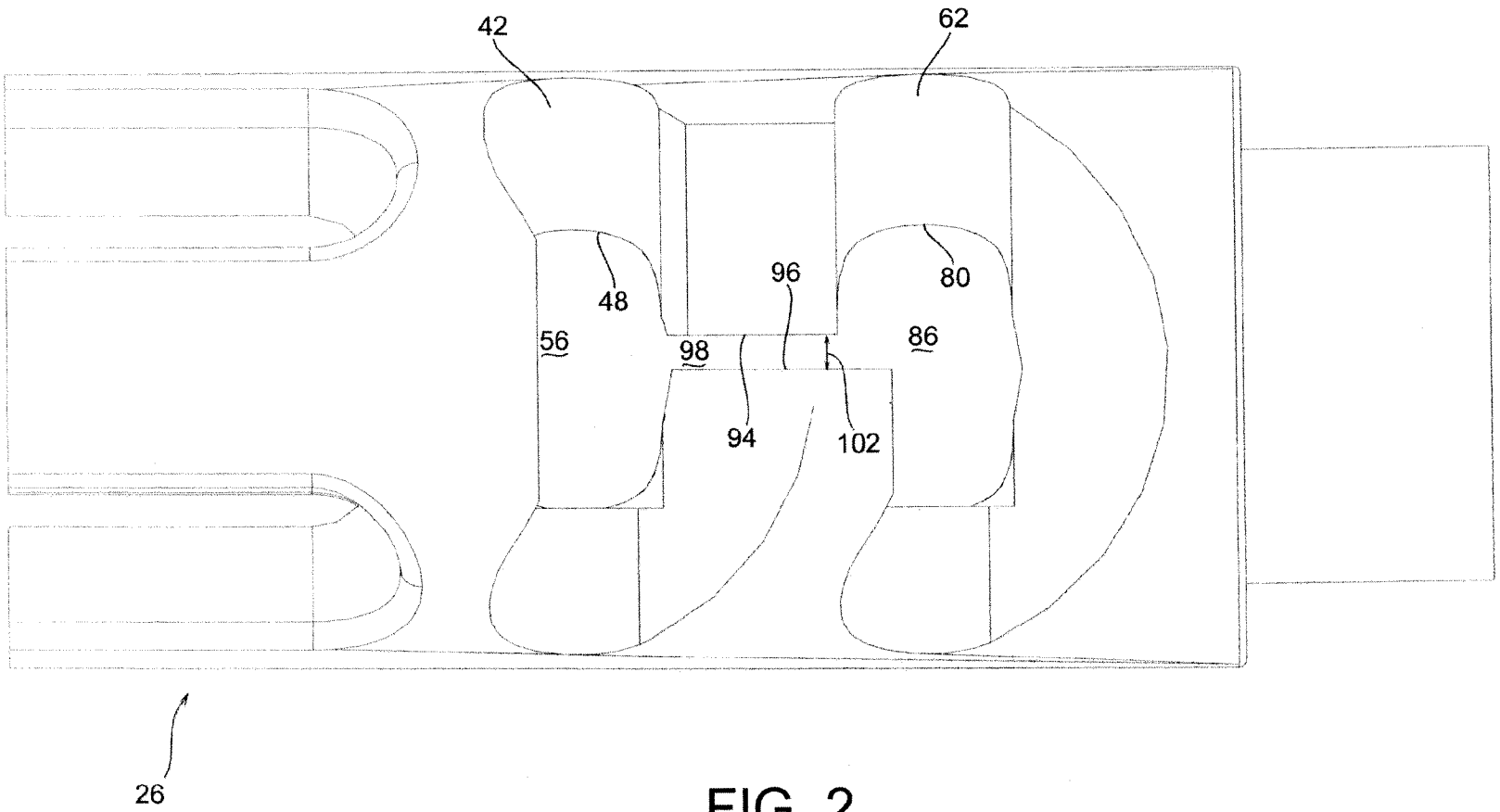
FIG. 2 shows a lateral view of the muzzle device taken from the left lateral side from the orientation of a shooter behind the muzzle.
Figure 6:
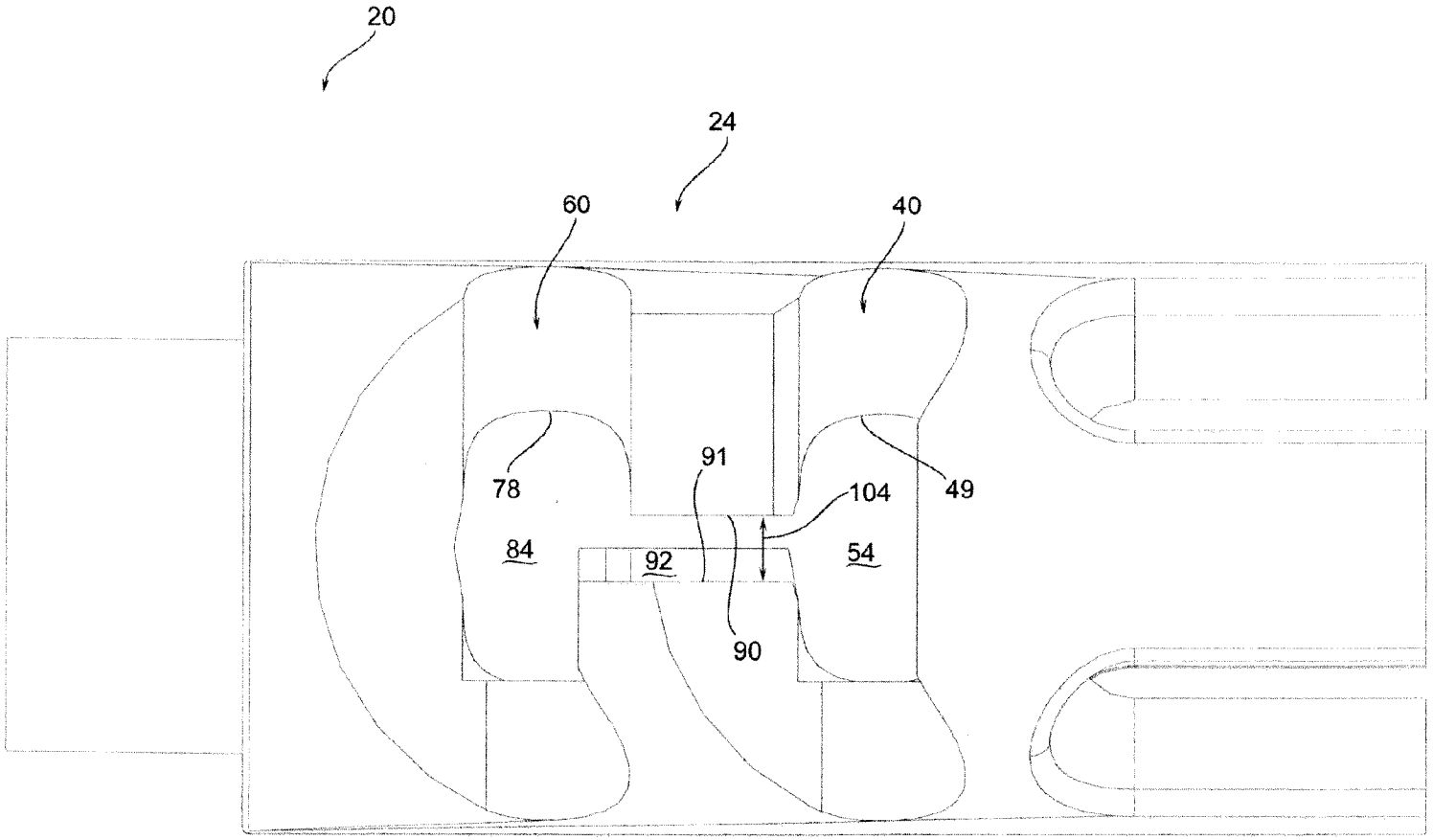
FIG. 6 shows an opposing lateral view to that of FIG. 2 where the vantage point of this lateral view is from the right-hand lateral portion of the muzzle device from the perspective of a shooter positioned behind the muzzle device in the longitudinal direction.
Figure 8:
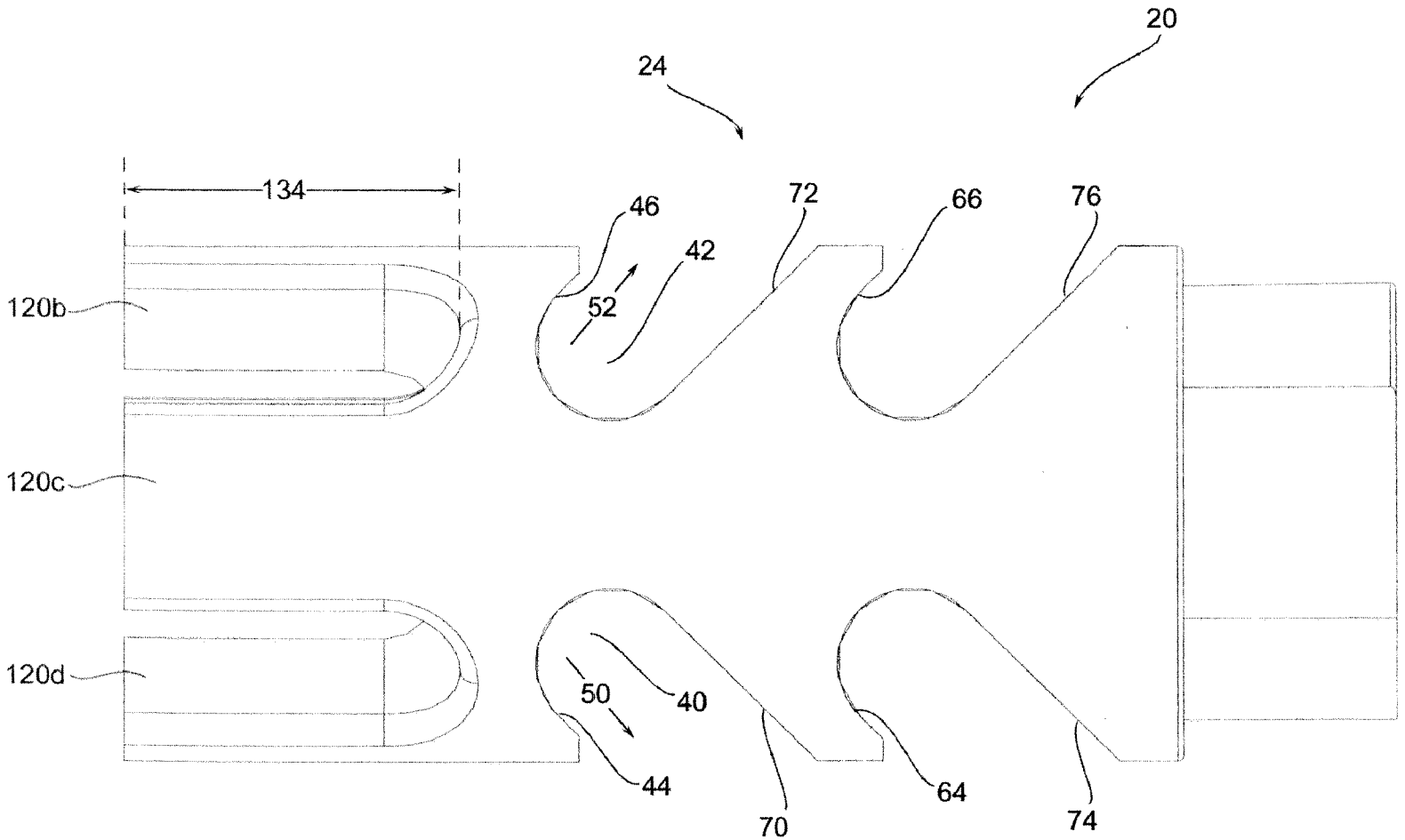
FIG. 8 shows a bottom view of the muzzle device.
Figure 9:
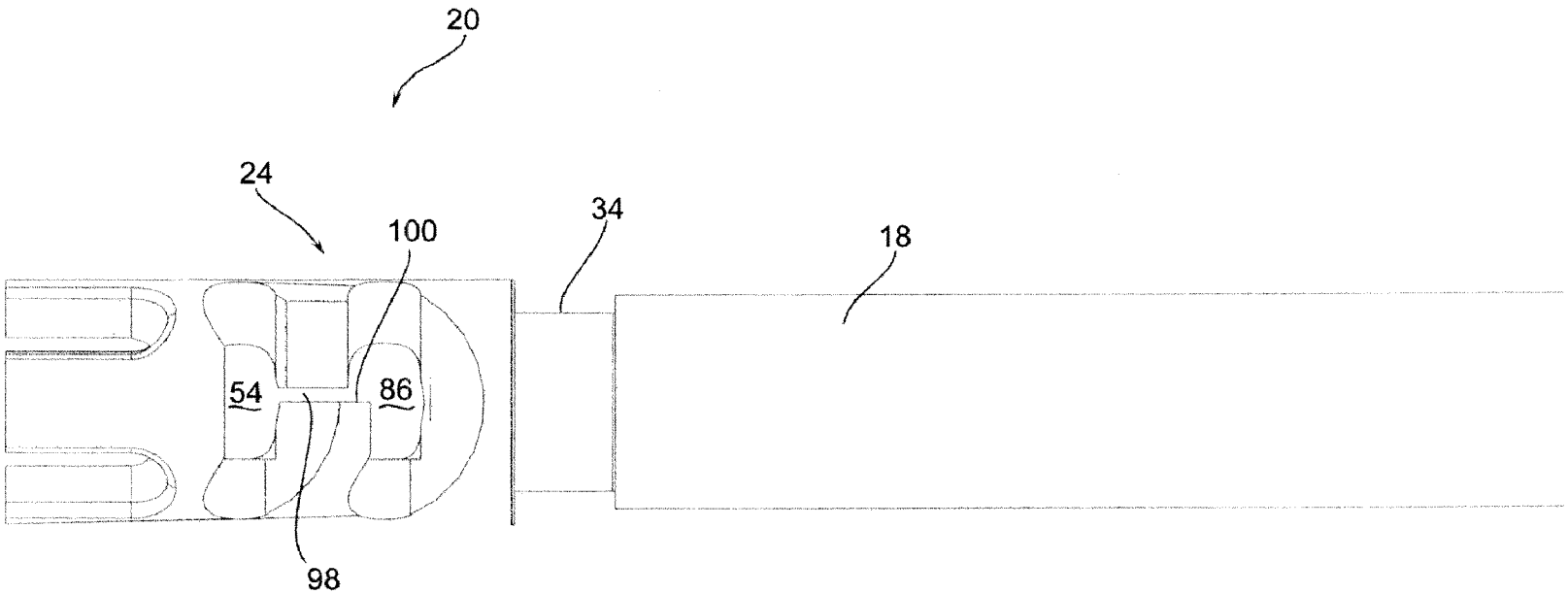
FIG. 9 shows a side view of the lateral direction on the left-hand side of the muzzle device attached to a barrel.
Figure 10:
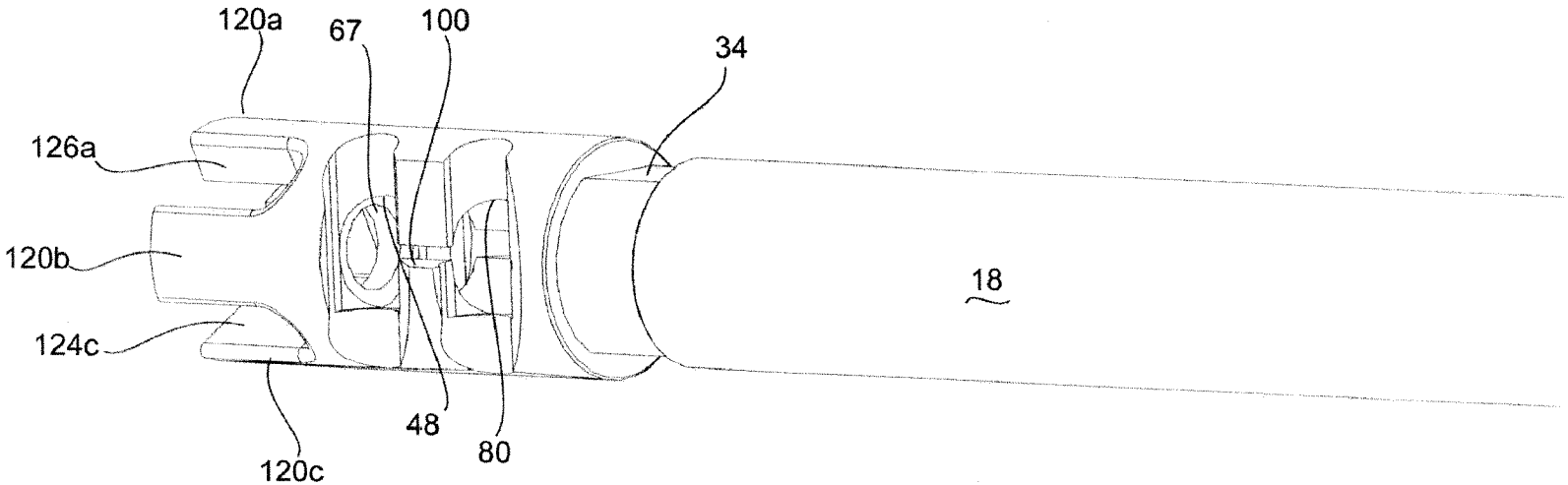
FIG. 10 shows the muzzle device attached to a barrel from a left hand lateral side view and slightly longitudinal rearward vantage point.

Referring now to FIGS. 2 and 6, there are shown opposing lateral sides of the compensator region 24. Referring first to FIG. 6, it can be appreciated that in one form, the compensator region comprises a first compensator port 40 and FIG. 2 illustrates a second compensator port 42. The compensator ports are in one form configured to direct gas in a longitudinal rearward direction. As shown in FIG. 8, there is a bottom view of the muzzle device 20 with a first lateral longitudinally rearward slanted surface 44 and a second lateral longitudinally rearward slanted surface 46. These surfaces 44 and 46 are configured to redirect the gas in a longitudinally rearward direction, as shown by arrows 50 and 52. As further shown in FIG. 2, there is an interior surface edge 48 and a corresponding surface edge 49 in FIG. 6 which defines the first and second port openings 54 and 56 which are in communication with the first and second compensator ports 40 and 42.

Still referring to FIGS. 2 and 6, in one form there is shown a third lateral compensation port 60 and a fourth lateral compensation port 62. In a like manner, the third and fourth lateral longitudinally rearward slanted surfaces 64 and 66 are provided to redirect gas in a longitudinal rearward fashion in like manner as the surfaces 44 and 46 described above (see FIG. 8). The first, second, third and fourth lateral compensation ports each further comprise the longitudinally rearward surfaces 70, 72, 74 and 76 as shown in FIG. 8 which aid in the direction of the gas in the longitudinally rearward direction. As shown in FIGS. 6 and 2, the interior surface edges 78 and 80 define the third and fourth port openings 84 and 86.

Therefore, it can be appreciated that the compensator region in part comprises (in one form at least) two pairs of lateral compensation ports that are positioned in the opposing lateral regions of the muzzle device 20.

With the foregoing description in mind, there will now be a discussion of access vents which in one form provide communication between port openings on the corresponding lateral locations of the muzzle device. Referring first to FIG. 6, there is shown the first and third port openings 54 and 84. The edge surfaces indicated at 90 and 91 in one form define a first access vent 92 which provides communication between the first and third port openings 54 and 84.

Figure 7:
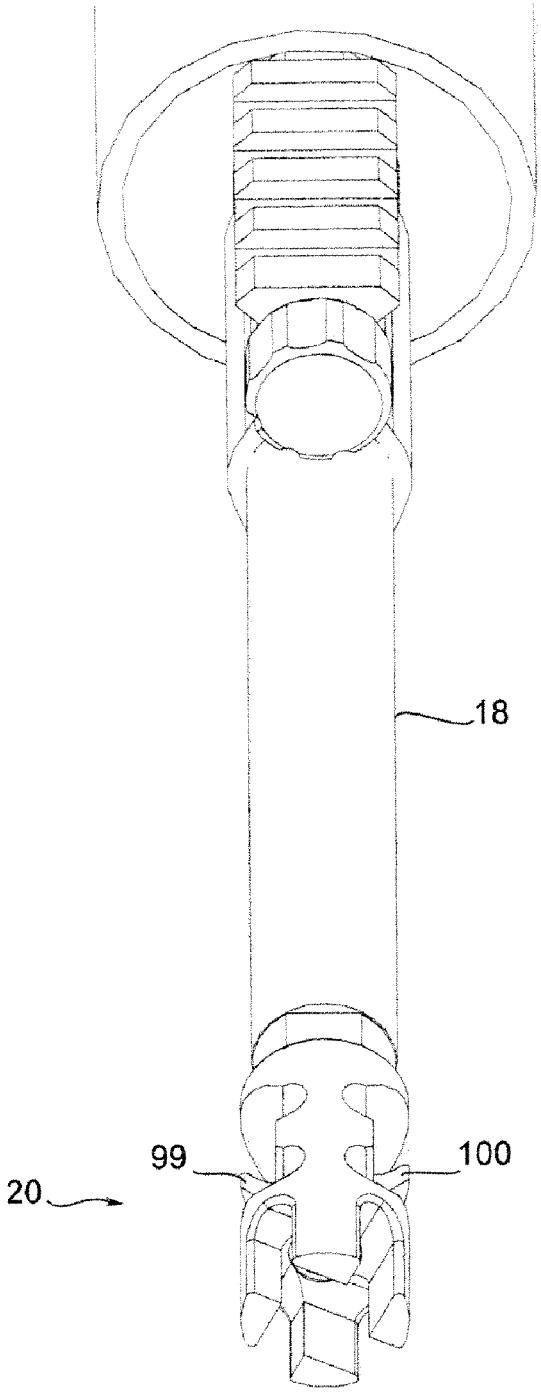
FIG. 7 shows a top view of the muzzle device taken downstream of the muzzle from a vertically upward vantage point.
Figure 11:
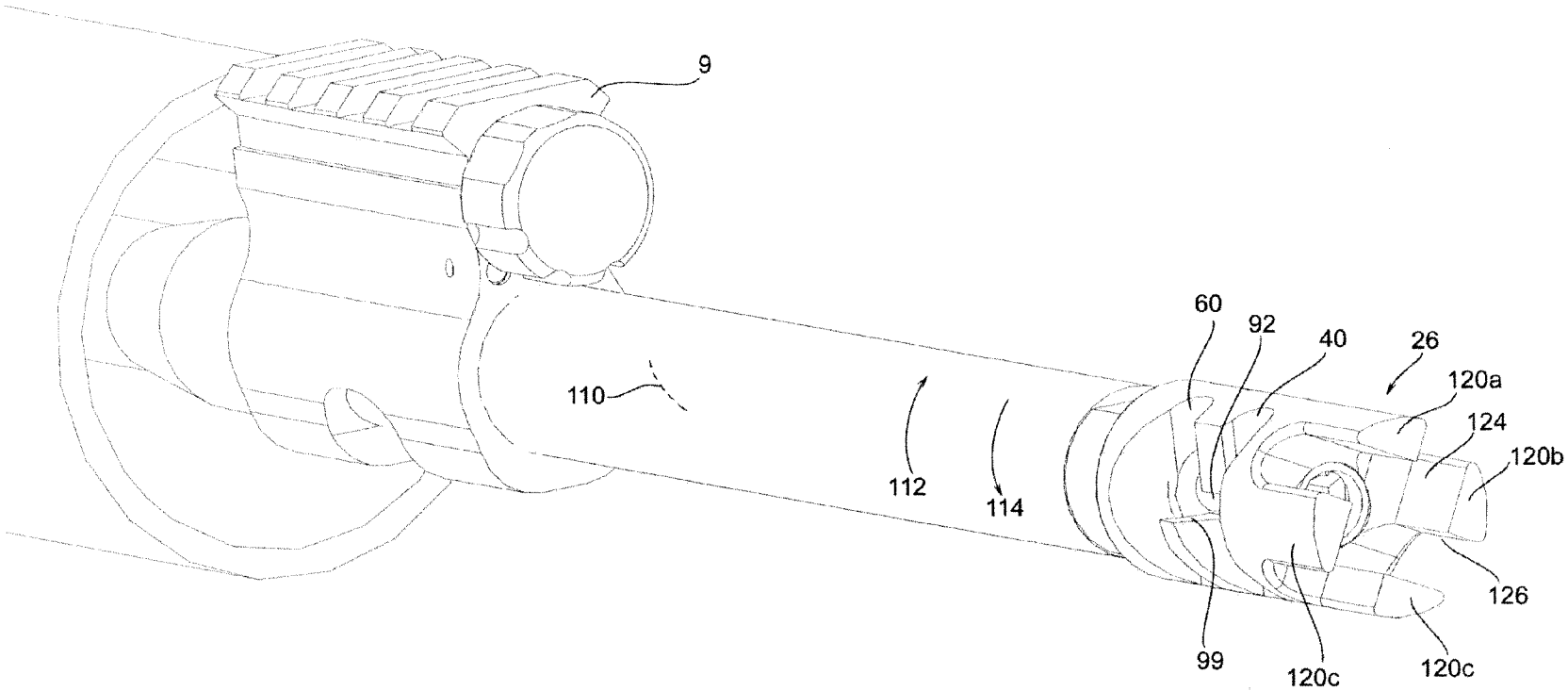
FIG. 11 shows a portion of the upper assembly and barrel attached to the muzzle device illustrating the concepts of the torques acting thereupon the barrel and the counter-torques provided by the counter lift surfaces of the muzzle device.

Now referring to FIG. 2, there is shown interior edge surfaces 94 and 96 which in part define the second access vent 98. Referring now to FIG. 5, it can be appreciated that adjacent to the edge surface 96 is the second counter lift surface 100. In a like manner as shown in FIG. 11, on the opposing lateral side is a first counter lift surface 99. As shown in FIG. 7, there is an isometric view of the muzzle device 20 attached to a barrel 18, and this particular view is downstream of the muzzle taken from a vantage point above the centerline bore of the muzzle where it can be appreciated that the first and second counter lift surfaces 99 and 100 are positioned at opposing lateral regions (not necessarily directly opposite) of the muzzle device 20. FIG. 2 provides an opportunity to introduce the difference of the vertical widths of the first and second access vents 92 and 98. Referring initially to FIG. 2, it can be appreciated that the second access vent 98, which is defined by the edge surfaces 94 and 96 (see also FIG. 5 for an isometric view), is defined by a vertical width 102. Of course, the width 102 need not be uniform in the longitudinal direction along the edge surfaces 94 and 96. But in general, the width 102 is less than the width 104 as shown in FIG. 6, which defines the width opening of the first access vent 92. With a right-handed twist barrel, there is a certain amount of counter-rotational torque acting upon the barrel and the firearm in general. As shown in FIG. 11, it can be seen how the first access vent 92 is greater in a cross-sectional open area than the second access vent 98 as shown in FIG. 5. By providing a greater open region to the first counter lift surface 99, a greater amount of expanding gas can be ejected through the first access vent, thereby having greater effect of a counterforce upon the first counter lift surface 99. In other words, with a right-handed twist barrel, the exterior surface of the bullet travels in a helical path as shown by the hatched line 110 in FIG. 11. Of course, the bullet begins from rest and must accelerate not only in the longitudinal direction but also will have an angular acceleration. For example, with a .223 caliber it is common to have a 7:1 twist (that is one rotation per 7 inches of longitudinal travel) when reaching velocities of several thousand feet per second, for example 3000 feet per second, a bullet such as an 80 grain bullet may have a rotational velocity of several hundred thousand rotations per minute. Even a relatively light bullet compared to the mass of the gun can create a certain amount of counter torque upon the barrel which is transferred to the firearm. This counter torque produced from the bullet of course creates a net torquing effect illustrated by the torque vector 112. Therefore, the first counter lift surface 99 (FIG. 11) will have a slightly greater amount of gas acting thereupon than the second counter lift surface 100 (FIG. 5) will produce a counter torque vector 114, thereby reducing the propensity for the firearm to twist about the longitudinal axis during operation.

Referring now back to FIG. 7, it therefore can be appreciated why the first counter lift surface 99 is positioned slightly lower than the second counter lift surface 100. Of course, in other forms these surfaces may not be offset, and the interior edge surface 90 as shown in FIG. 6 could simply be repositioned vertically higher.

With the foregoing description of the compensator region 24 in place, there will now be a discussion of the flash suppression region 26 with initial reference to FIG. 1A. As shown in FIG. 1A, the flash suppression region 26 in one form is comprised of a plurality of longitudinal extensions 120 which are specifically denoted as 120*a*, 120*b*, 120*c*, and 120*d*.

Referring now to FIG. 11, there is a more close-up view of the flash suppression region 26 where the longitudinal extension 120*b* will be described in detail with the understanding that the description is relevant to the other longitudinal extensions. Of course, a plurality of extensions can be utilized, of an amount less than three and greater than four. Further, although there are some desirable ranges that have been determined empirically as described herein with regard to the length of the longitudinal extensions, the general operation of the extensions is to create a rotating vortex-like action of the expanding gas. This of course is one form of a flash suppression technology, and other forms may be utilized. As described herein, other forms such as the "birdcage" design could be incorporated in the broader scope.

Now referring to FIG. 11, it can be appreciated that the first and second offset surfaces 124 and 126 are provided on the extension 120*b*. Both of these surfaces have a component extending in the longitudinal direction. The embodiment as shown in FIG. 11 shows one form where the surfaces extend substantially directly along the longitudinal direction. Referring back now to FIG. 3, there is an end view looking down the muzzle. It can be appreciated that the barrel has an interior chamber 119 and an interior surface 121. In general, the interior surface 121 has lands and grooves which are configured to engage the outer surface of a bullet. As described above, the lands and grooves are most often rotated in a longitudinal direction to provide spin to the bullet, creating a torque indicated by the vector 112 in FIG. 11. (See the description above related to the first counter lift surface 99). Referring back to FIG. 3, it can be further appreciated that the interior chamber 119 provides not only the exit of the bullet, but the exit of expanding gases. It should be noted that the compressed gas leaving the bullet will exit to the various ports and chambers of the muzzle device 20. Downstream of the bullet is the combustion gas from the most common combustible materials such as gunpowder or cordite. This combustion material passes through the interior chamber 119 of the barrel and in one form is simply exhausted out the muzzle of the barrel as in prior art devices. This expanded combusted and semi-combusted gas can provide utility for reducing the longitudinally rearward-felt recoil upon the firearm, reducing the lift of the muzzle during firing, reducing the rotational torque acting upon the firearm by the rotational acceleration of the bullet, and finally the pressure of the expanding gas can be utilized to aid in extinguishing a portion of the visible flame by way of the flash suppression region 26.

Figure 3:
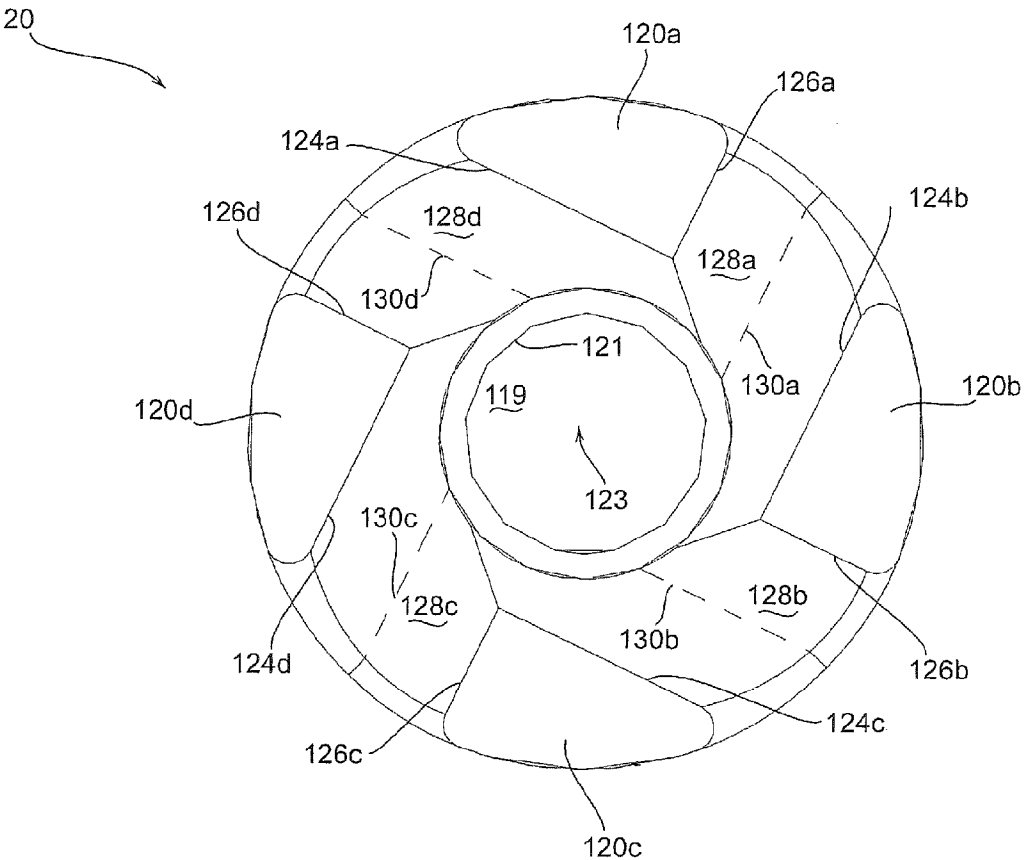
FIG. 3 shows a front view in the longitudinal direction of the muzzle device showing the various channel regions of the flash suppressor region.

As shown in FIG. 3, the first and second surfaces 124 and 126 are shown. To aid in the description, the correlating surfaces on adjacent members will be utilized with the corresponding alpha character (e.g. "a", "c", or "d"). It can be appreciated that the adjacent longitudinal extensions 120*a* and 120*b* provide corresponding surfaces 126*a* and 124*b*. These sets of surfaces provide channel regions throughout the unit which are generally denoted at 128*a*, 128*b*, 128*c* and 128*d*. Each one of these channel regions provides a general central axis 130*a*, 130*b*, 130*c*, and 130*d* which are all offset from the center point 123 of the interior chamber 119. Therefore, it can be appreciated that gas generally traveling through the channel regions 128 will have a proximate center axis of travel along the axis 130. Therefore, analyzing each of the channel regions 128 as a thruster, it can be appreciated that if the gas generally travels along the center axis 130 of each of the channel regions 128, there could possibly be a counter-torque action upon the barrel, but moreover, these offset channel regions tend to produce a rotating vortexing-like exhaust of the gas which has a propensity to extinguish the flame of the gas that is still combusting, thereby reducing the net amount of lumens produced while firing a round. It should be noted that in general, expanding gas will tend to expand directly radially outward from the center point 123. By forcing the gas to the channel regions 128, the expanding gas will tend to take a nonlinear radially outward path but provide a certain amount of rotation, and present analysis indicates a more turbulent-like action to combust the not-yet fully combusted particulate matter.

Referring now to FIG. 8, there is shown a bottom view of the muzzle device 20 where the dimension 134 is provided. In one form, the dimension 134 can be approximately one half of an inch (plus or minus 10% in one form and plus or minus 20% in a broader scope). By way of experimentation, when firing a .223 rifle round, a half-inch longitudinal extension 120 provided a surprising result of suppressing a flame greater than a longer longitudinal extension of three-quarters of an edge. Present analysis by the applicants conjectures that the reason for this phenomenon could be that a longer longitudinal extension had the effect of igniting additional ignitable material from the gunpowder, or some derivatives of the gunpowder during the firing process, which produced radially extending sparks. However, shortening the longitudinal extensions to approximately one-half of an inch in testing provided greater flash suppressing results. Of course it should be noted that the pressures within the chamber of a firearm when filing a high caliber rifle round can exceed 60,000 psi. This relatively highly pressurized environment, which is induced by combusting material which is all conducted in a closed chamber, makes analysis rather challenging. Further, compounding the issues of the expanding gas with different types of gun powders having different combustion rates and different bullet sizes having different degrees of mass makes analysis upon the overall system difficult. One surprising effect of the device 20 is that in this highly volatile exothermic process of firing a bullet, experimentation has indicated that the portion of the combusted material which is produced in the flame tends not to exit the compensator region 24, as shown in FIG. 5.

As further shown in FIG. 5, there is a baffle region 67 which in a preferred form is cylindrical having a center axis that is common with the center axis 123 of the muzzle as shown in FIG. 3. This baffle 67 can be, for example, between 0.015-0.040 inches radially around the perimeter region of the bullet configured to pass therethrough. One preferred form of the baffle member is to provide a 0.030 inch clearance radially around the perimeter of the prescribed caliber of the rifle (that is, having a 0.060 inch diameter greater than the diameter of the bullet), but of course this value can and may vary depending on various factors, such as the size of the bullet and the operating pressures of the cartridge utilizing that particular bullet projectile. As the bullet passes through the baffle 67 as shown in FIG. 5, a portion of the trailing gas of the bullet is ejected through the various compensator ports. The exact phenomenon regarding why a portion of the flame caused by the combusted material trailing the bullet does not exit through these compensator ports is not completely understood. However, in one form, having the compensator region 24 positioned rearwardly of the flash suppression region 26 provides a very desirable muzzle device 20 meeting numerous objectives.

With the foregoing description in place, there will now be a general description of another embodiment. Description of the second embodiment is made with reference to FIGS. 12-15. The previous embodiment shows one sample for a 22-caliber rifle, and more specifically a .223 cartridge, otherwise referred to as a 5.56×45 mm round which is a conventional round for an AR-15 as well as numerous other rifle models. The embodiment as shown in FIGS. 12-15 shows several different concepts with regard to the compensator region 224, but the specific design as shown in this embodiment is for a 30-caliber rifle such as a 7.62 mm cartridge which is conventional for an AK-47 as well as many other types of rifle models. Of course, the concept of the extra port described herein can be utilized for either caliber and additional calibers. For purposes of the description, all of the figures shown in the application are to scale, showing one form of carrying out the concept per embodiment. Of course, other dimensions and orientations can be utilized without departing from the applicants' broadly claimed invention.

Figure 12:
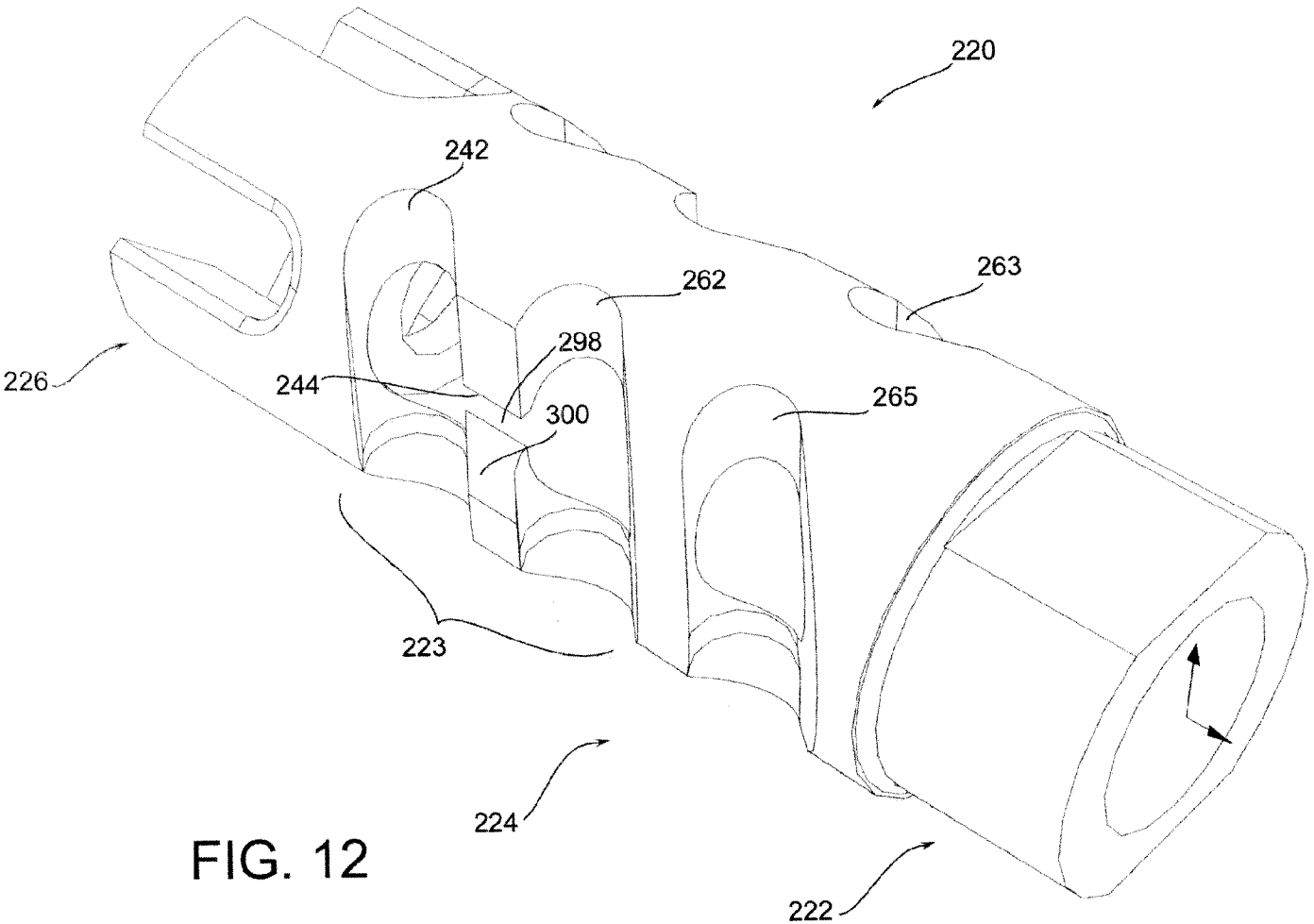
FIG. 12 shows a second embodiment of an example of the muzzle device.
Figure 13:
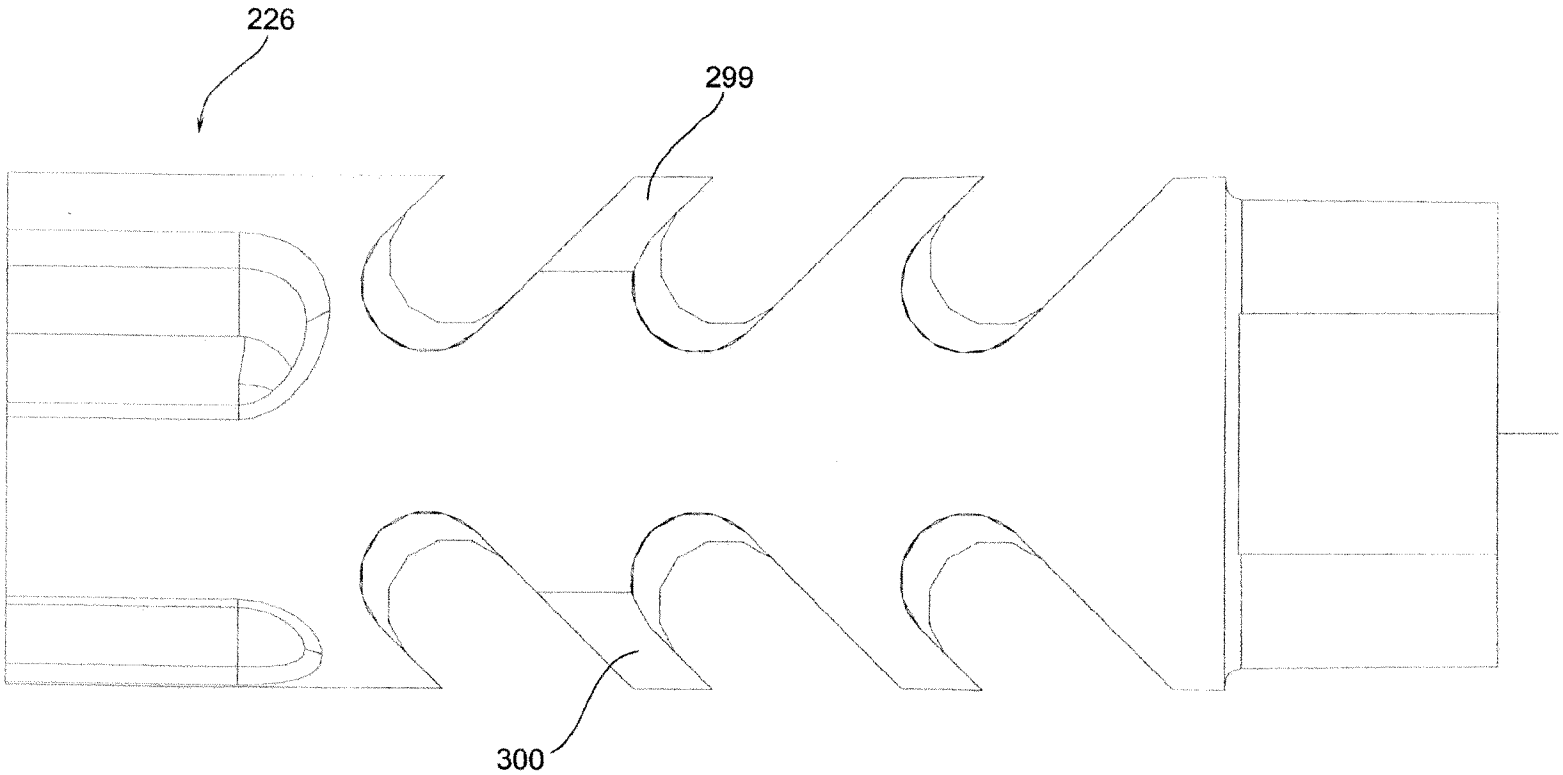
FIG. 13 shows a top view of the second embodiment of the muzzle device.
Figure 14:
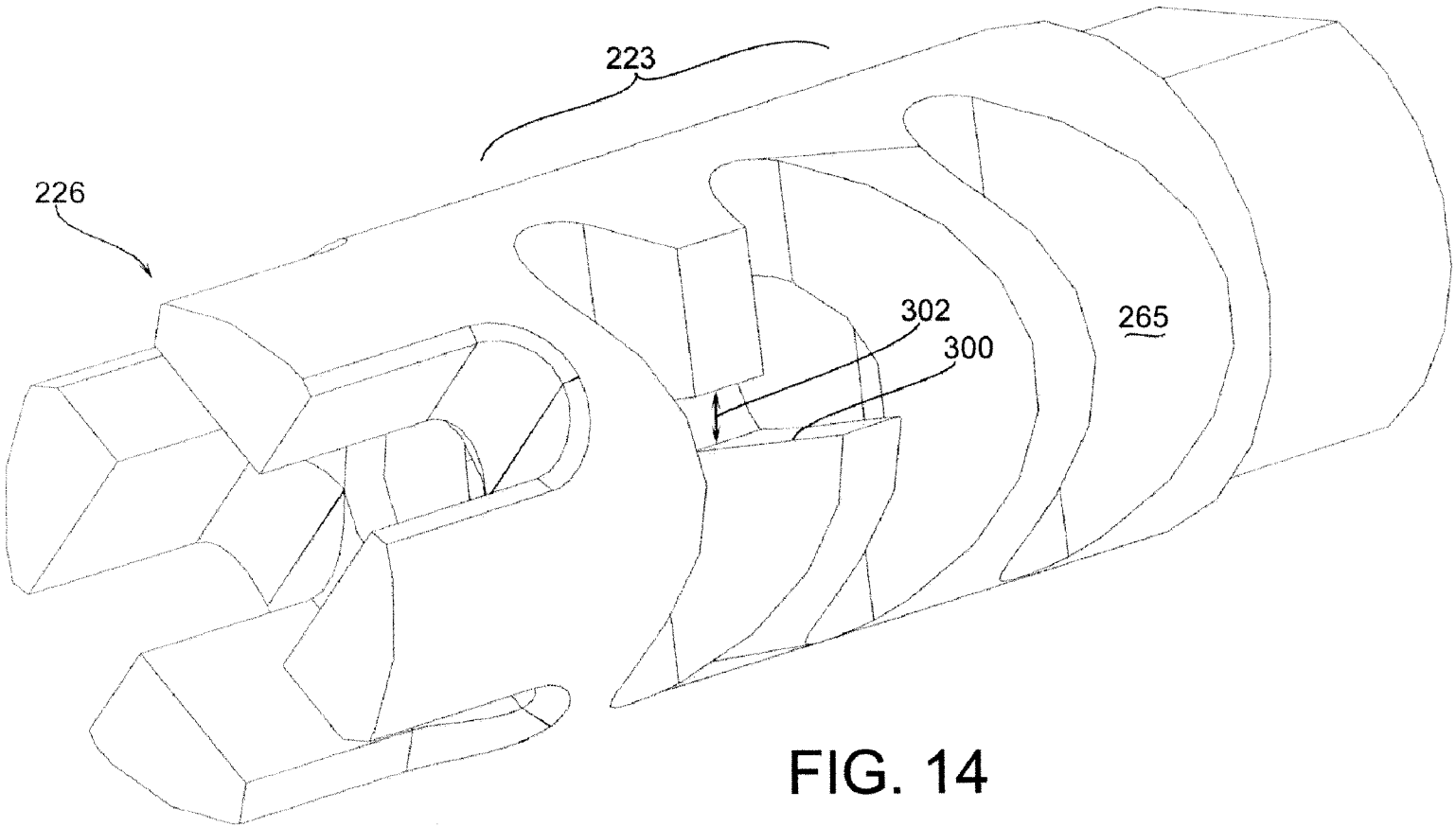
FIG. 14 shows an isometric view of the second embodiment taken at an upward and longitudinal forward vantage point.
Figure 15:
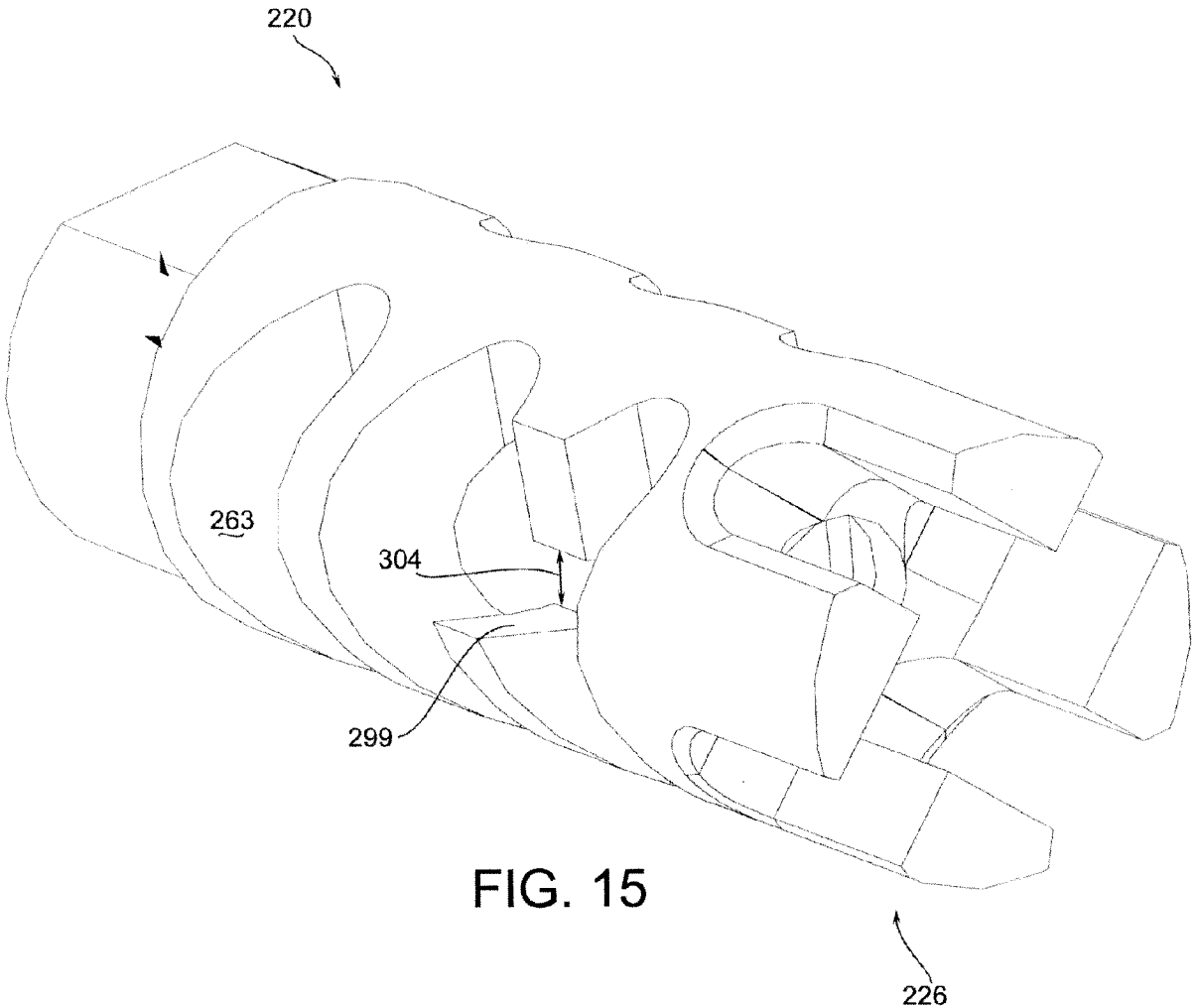
FIG. 15 shows another isometric view of the second embodiment taken from a longitudinally forward and upward vantage point on the right-hand lateral side of the device.

Referring now to FIG. 12, it should first be noted that when possible, similar components will have similar numeral designations to the first embodiment but will be incremented by a numeric value of 200, or will have a preceding 2 before any two digit numeral designations. Therefore, the muzzle device 220 shown in FIG. 12 generally shows the compensator region 224 as well as the attachment region 222 and the flash suppression region 226. It can immediately be identified that the muzzle compensation region 224 has a similar compensator area 223 having an access vent 298 providing communication for the second and fourth compensation ports 242 and 262. However, FIG. 12 further shows one permutation (of many) where the fifth and sixth compensation ports 263 and 265 are shown, which are positioned longitudinally rearwardly of the compensation area 223. FIG. 13 shows a similar manner of having first and second counter lift surfaces 299 and 300. FIGS. 14 and 15 show isometric views on opposing lateral regions of the compensator device 220, and it can be appreciated that the dimensions 302 and 304 can be of different values to provide greater access to the second and first counter lift surfaces 300 and 299 respectively.

Of course, the embodiment as shown in FIGS. 12-15 is by way of example, and there can be numerous combinations of additional ports and surfaces employed without departing from the basic teachings of the muzzle device.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those skilled in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A muzzle compensator comprising:

a) a center bore having a center bore axis, b) an attachment region having a threaded portion and a torque receiving surface, c) a vortexing region having a plurality of vortex channels wherein each of the vortex channels each having a center axis that is offset from the center bore axis and is substantially perpendicular thereto;

d) a compensator region having a first longitudinally rearward slanted surface and a second longitudinally rearward slanted surface substantially laterally opposed to the first longitudinally rearward slanted surface; defining respectively in part a first compensator port and a second compensator port;

e) a first and a second counter-lift surface positioned in a first and a second lateral region respectively, the first counter lift surface and the second counter lift surface being in open fluid communication with a first and a second access vent respectively which provide open fluid communication to the center bore.

2. The muzzle compensator as recited in claim 1 further comprising a third longitudinally rearward slanted surface and a fourth longitudinally rearward slanted surface, substantially laterally opposed to the third longitudinally rearward slanted surface; defining respectively in part a third compensator port and a fourth compensator port.

3. The muzzle compensator as recited in claim 2 where the first access vent provides open fluid communication between the first compensator port and third compensator port.

4. The muzzle compensator as recited in claim 3 where the second access vent provides communication between the second compensator port and fourth compensator port.

5. The muzzle compensator as recited in claim 4 where the width of the second access vent is greater than the width of the first access vent.

6. The muzzle compensator as recited in claim 5 where the second access vent is at least 0.025" larger in width than the first access vent.

7. The muzzle compensator as recited in claim 6 where the muzzle compensator is affixed to a firearm having a right-handed twist barrel.

8. A muzzle device having a longitudinal axis indicating forward and rearward longitudinal directions, the muzzle device configured to be attached to a firearm barrel having pressurized gas emitting therefrom, the muzzle device comprising:

a) a first compensator port defined by a first interior edge surface and a second compensator port defined by a second interior edge surface substantially laterally opposed to the first compensator port;

b) a third compensator port defined by a third interior edge, a fourth compensator port defined by a fourth interior edge surface substantially laterally opposed to the third compensator port;

c) a first access vent defined by a first edge surface and a second edge surface, the first access vent extending in a longitudinal direction and providing an open fluid communication region between the first compensator port and the third compensator port;

d) a second access vent defined by a third edge surface and a fourth edge surface, the second access vent extending in the longitudinal direction and providing an open fluid communication region between the second compensator port and the fourth compensator port;

e) a first counter lift surface positioned adjacent to the first access vent, the first counter lift surface having a horizontal component thereof configured to have pressurized gas impinge thereupon when exiting the first access vent;

f) a second counter lift surface positioned adjacent to the second access vent, the second counter lift surface having a horizontal component configured to have the compressed gas impinge thereupon when exiting the second access vent.

9. The muzzle device as recited in claim 8 where the first access vent has a greater open cross-sectional area than the second access vent.

10. The muzzle device as recited in claim 8 where the first, second, third and fourth compensator ports each have a longitudinally rearward slanted surface operatively configured to direct the expanding gas in a longitudinally rearward direction.

11. The muzzle device as recited in claim 10 where the distance between the first and second edge surfaces defining the first access vent is greater than the distance between the third and fourth edge surfaces defining the second axis vent.

12. The muzzle device as recited in claim 11 where the first counter lift surface provides a greater rotational torque than the second counter lift surface when expanding gas exits through the first and second access vents.

13. The muzzle device as recited in claim 11 where a flash suppression region is positioned longitudinally forward of the first, second, third and fourth compensator ports.

14. The muzzle device as recited in claim 13 where the flash suppression region comprises a plurality of vortex channels wherein each of the vortex channels comprises a center axis that is offset from a longitudinal center axis of the muzzle device and is substantially perpendicular thereto.

15. The muzzle device as recited in claim 8 where a flash suppression region is positioned longitudinally forward from the first and third compensator ports.

16. The muzzle device as recited in claim 15 where a baffle is interposed between the first and second compensator ports and the flash suppression region.

17. The muzzle device as recited in claim 16 where the baffle defines a central baffle opening which is less than 0.090 inches greater in diameter than the size of a prescribed bullet designed to pass through the muzzle device.

18. The muzzle device as recited in claims 16 where the central baffle opening is approximately 0.060 inches in diameter greater than the size of a prescribed bullet diameter for use with the muzzle device.

19. The muzzle device as recited in claim 8 where a fifth and sixth compensator ports are positioned longitudinal rearwardly from the third and fourth compensator ports.

20. A method of utilizing compressed gas from a cartridge of a firearm as a bullet is fired from the cartridge and passes through a barrel of a firearm with expanding combusted gas positioned longitudinally rearward therefrom, the method comprising:

a) positioning a first, a second, a third, and a fourth compensation ports respectively on opposing lateral regions at an end region of the barrel having a bore with a center axis;

b) providing each compensator port with a longitudinally rearwardly slanted surface in the longitudinally forward portion of each respective compensator port;

c) providing the first and third compensator ports positioned on a first lateral side with a first edge surface and a second edge surface defining a first access vent providing an open fluid communication region between the first and third compensator ports;

d) providing a third edge surface and a fourth edge surface defining a second access vent providing an open fluid communication region between the second and fourth compensator ports which are positioned on a second lateral side which opposes the first lateral side containing the first and third compensator ports;

e) providing a first counter lift surface and a second counter lift surface on opposing lateral sides where the first counter lift surface is adjacent to the first access vent and the second catalyst surface is adjacent to the second access vent;

f) providing a flash suppression region longitudinally forward of the compensation ports where the flash suppression region provides surfaces to form a plurality of vortex channels wherein each of the vortex channels comprise a center axis that is offset from the center axis of the bore of the barrel and is substantially perpendicular thereto.

21. The method as recited in claim 20 where the first, second, third and fourth compensator ports and the flash suppression region are of a unitary structure.

22. The method as recited in claim 21 where the unitary structure is configured to be attached to the end portion of the barrel and be threadedly engaged thereto.

23. The method as recited in claim 21 where the unitary structure is fixedly and permanently attached to the end region of the barrel.

24. The method as recited in claim 20 where a baffle cylindrical region is interposed between the compensator region and the flash suppression region so as to provide an increase of pressure trailing the bullet as it passes through the baffle region.

* * * * *